US005285927A

United States Patent [19]

Pruitt

[11] Patent Number: 5,285,927

[45] Date of Patent: Feb. 15, 1994

[54] CONTAINER/DISPENSER FOR USED PLASTIC SACKS

[76] Inventor: Sam Pruitt, 2021 Ocean Ave., Apt. 309, Santa Monica, Calif. 90402

[21] Appl. No.: 25,857

[22] Filed: Mar. 3, 1993

[51] Int. Cl.[5] ..... B65G 59/10

[52] U.S. Cl. ..... 221/22; 221/52; 221/57; 221/61; 221/63; 221/64; 221/281; 221/303; 221/307

[58] Field of Search ..... 221/22, 240, 279, 281, 221/303, 307, 33, 45, 46, 47, 52, 55, 56, 57, 61, 63, 64, 66, 312 R, 312 C; 225/52

[56] References Cited

U.S. PATENT DOCUMENTS

| | | | |
|---|---|---|---|
| 1,375,520 | 4/1921 | Kingsley | 221/63 X |
| 1,692,463 | 11/1928 | Merrin | 221/56 X |
| 1,915,006 | 6/1933 | Swift | 221/63 |
| 2,112,960 | 4/1938 | Harvey | 221/63 X |
| 2,206,838 | 7/1940 | Emerson | 221/63 X |
| 2,414,847 | 1/1947 | Amberg | 221/63 |
| 3,228,556 | 1/1966 | Nonestied | 221/279 |
| 4,684,036 | 8/1987 | Brewer | 221/63 X |
| 4,811,878 | 3/1989 | Horinchi | 221/46 X |
| 4,905,868 | 3/1990 | Beane et al. | 221/63 X |
| 5,042,687 | 8/1991 | McKinley | 221/45 X |
| 5,100,020 | 3/1992 | Petterson | 221/55 X |
| 5,197,631 | 3/1993 | Mishima | 221/56 X |

FOREIGN PATENT DOCUMENTS

| | | | |
|---|---|---|---|
| 3127358 | 1/1983 | Fed. Rep. of Germany | 221/45 X |

*Primary Examiner*—D. Glenn Dayoan
*Assistant Examiner*—Dean A. Reichard
*Attorney, Agent, or Firm*—Beehler & Pavitt

[57] ABSTRACT

A container/dispenser for used plastic shopping bags which comprises a walled vessel having an open top and an open bottom to which is secured a converging lower section formed of flexible walls with an internal friction surface terminating in a small opening through which the inserted bags may be withdrawn one at a time when compressed in the vessel by a handled lid pressed into the vessel.

8 Claims, 3 Drawing Sheets

CONTAINER/DISPENSER FOR USED PLASTIC SACKS

1. FIELD OF THE INVENTION

This invention relates generally to the container field, and specifically to a container for receiving and storing a plurality of plastic tissue-like sacks of the type currently used in grocery and other stores in packing merchandise purchased by customers for delivery to the latter at the check-out counters.

2. BACKGROUND OF THE INVENTION

In recent years, various types of stores, including particularly grocery stores, have been packing articles purchased by their customers in strong, tissue-like plastic sacks which are removed by check-out or packing clerks from several different types of racks, such as those illustrated in U.S. Pat. No. 3,454,166, issued to M. V. Dinges on Jul. 8, 1969, and in U.S. Pat. No. 4,676,378, issued to Baxley et al. on Jun. 30, 1987. The quantity of these sacks which may be dispensed by a single chain grocery store is tremendous. A single customer purchasing food for a family may easily come home with six to ten of these sacks while making a grocery shopping trip only once a week. After the purchased items are removed from the sacks, the wife or other householder who has made the purchases is then confronted with the problem of what to do with the empty sacks. Prior to 1988, and even since that time, countless grocery store purchasers have either crumpled up the sacks and disposed of them in trash containers, or stuffed them in a drawer or closet shelf for possible future re-use. After a while, the drawer may become packed with these bags and, should one be needed for reuse, when an effort is made to retrieve a single bag from the drawer, usually several bags will be found loosely connected and come out together so that it is then necessary to push the unwanted bags back in the overcrowded drawer.

Some attention was given to what to do about the accumulation of such plastic shopping sacks by the patentee of Patent No. 5,042,687, which issued Aug. 27, 1991, to The Bag-Saver International, Inc. of Ontario, Canada, as assignee of Thomas McKinley. While the shopping bag dispenser described and claimed in this last mentioned patent has been directed to attacking the problem of what to do with loose and untidy plastic bags and their reuse, the dispenser shown in that patent requires vertical slots, preferably above the horizontal dispensing slot in order to enable the sacks to be dispensed. In addition, because the horizontal dispensing slot is located above the floor of the container, it is believed that not infrequently, more than one sack may exit the horizontal slot when an effort is made to retrieve bags through the horizontal slot. In addition, it appears that the device of the McKinley patent contemplates the insertion of one's finger into the horizontal slot in order to remove the sacks from the container. It should also be noted that no particular means is suggested in the McKinley patent for compressing the bags in the container so that they may be easily dispensed, and that means are provided to effect a ratcheting of the bags which tends to prevent the bags from moving back upwardly after they may have been pushed downwardly by a hand or some object.

3. SUMMARY OF THE INVENTION

The container of the present invention seeks to accomplish the object of the McKinley patent in a more effective fashion and does so by, instead of providing a slot in the side wall through which a finger may be inserted in an effort to draw out plastic sacks one at a time, providing a container more in the nature of a hopper. Thus, the present invention allows the bags to be compressed downwardly through the bottom of a main wall storage space into a conical or tapered section having a relatively small opening where the apex of the cone would be projected. This conical or tapered section is defined by flexible walls which are internally roughened, such as would naturally occur where a course fabric such as sailcloth would be used. The main walls of the container desirably are slightly tapered inwardly from their upper edges to their lower edges and, in order to effect compression of the bags, a stepped lid may be provided to seat within the upper edges of the open top of the container.

As thus constructed, it will be found that once the first bag is pulled from the fabric opening, the roughened, flexible conical walls will restrain bags, other than the one being drawn through the opening, from following the latter bag—except for one succeeding bag, a portion of which may appear as the first bag is completely withdrawn. Therefor, the beginning of the succeeding bag will be found to be readily graspable by the user's fingers for removal from the hopper-like device and, as such, will offer certain decided advantages over the dispenser of the McKinley patent hereinabove referred to.

4. DESCRIPTION OF THE DRAWINGS

In the accompanying drawings.

5. DESCRIPTION OF THE PREFERRED EMBODIMENT

Figure 1A:
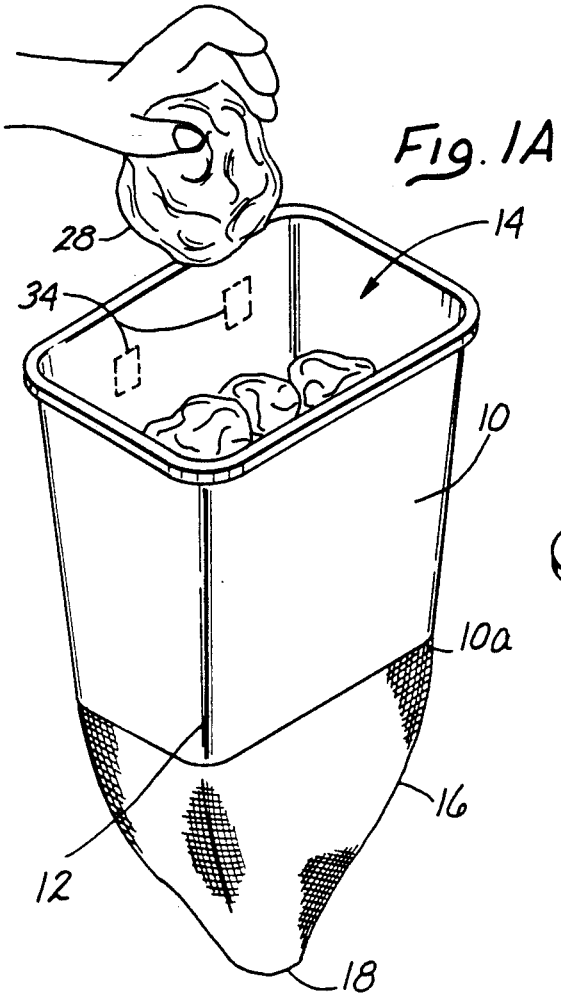
FIG. 1A is a perspective view of the container dispenser of the present invention showing a bag being inserted through the open top of the container.

Referring to FIGS. 1A, 2, 3, and 4, the container/dispenser of the present invention may be formed by rigid walls 10 joined at their corners or integrally molded to define a storage space 14. The walls 10 terminate at lower edges 10*a* to which may be secured a flexible downwardly extending tapered member 16 having an open lower end 18. Desirably, the inner walls 20 of the member 16 should be roughened or otherwise have a friction producing surface. The upper rim 20*a* of the member 16 may be secured by adhesive around the lower edges 10*a* of the walls 10. Alternatively, it might be possible to mold, as a single piece, both the walls 10 and the member 16 of some type of plastic where the walls 10 would be thick and rigid while the member 16 would be thin and flexible. As may be best seen from FIG. 3, desirably, the walls 10 should taper at least slightly downwardly between the upper edges 10*b* and the lower edges 10*a*.

It is also a feature of the present invention to provide a special lid 22, provided with a handle 24. The lid 22 may be formed of a plurality of blocks or plates 26*a*, 26*b*, and 26*c* with 26*b* being slightly smaller than plate 26*a* and 26*c* smaller than 26*b*.

Figure 2:
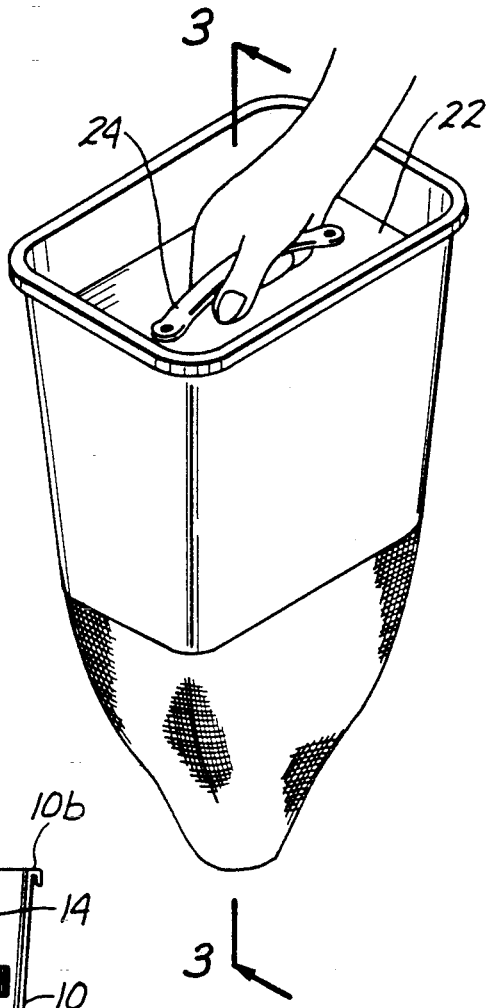
FIG. 2 is a perspective view similar to FIG. 1A but showing the application of the special lid to effect compression of the accumulated sacks.
Figure 3:
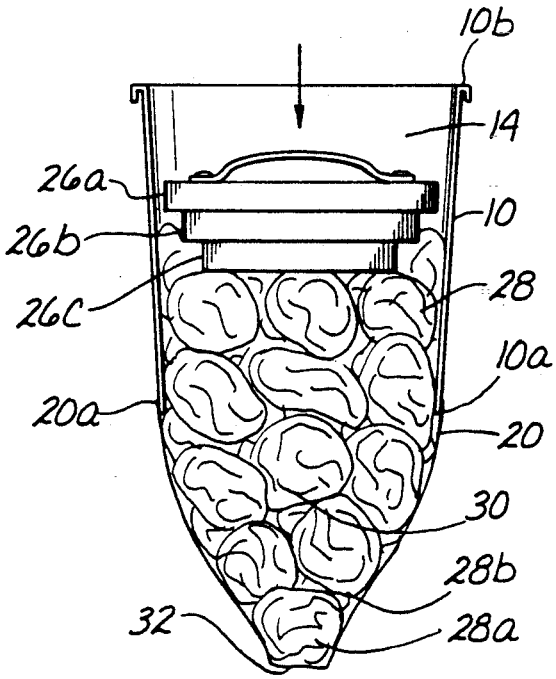
FIG. 3 is a section taken on the line 3—3 looking in the direction of the arrows but omitting the user's hand shown in FIG. 2.
Figure 1:
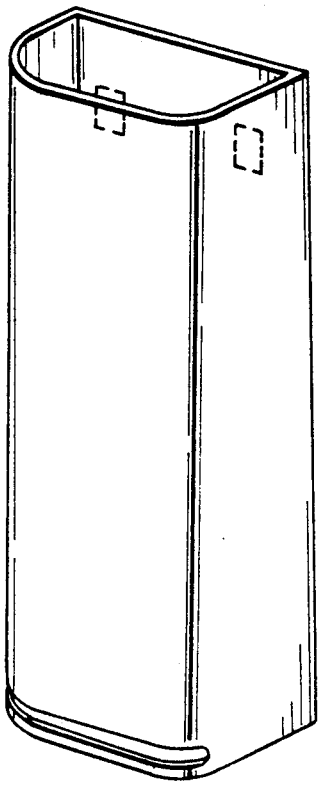
Fig. 1 PRIOR ART
FIG. 1 is a perspective view of a modified form of the dispenser of the McKinley patent which has been recently observed in use.
Figure 4:
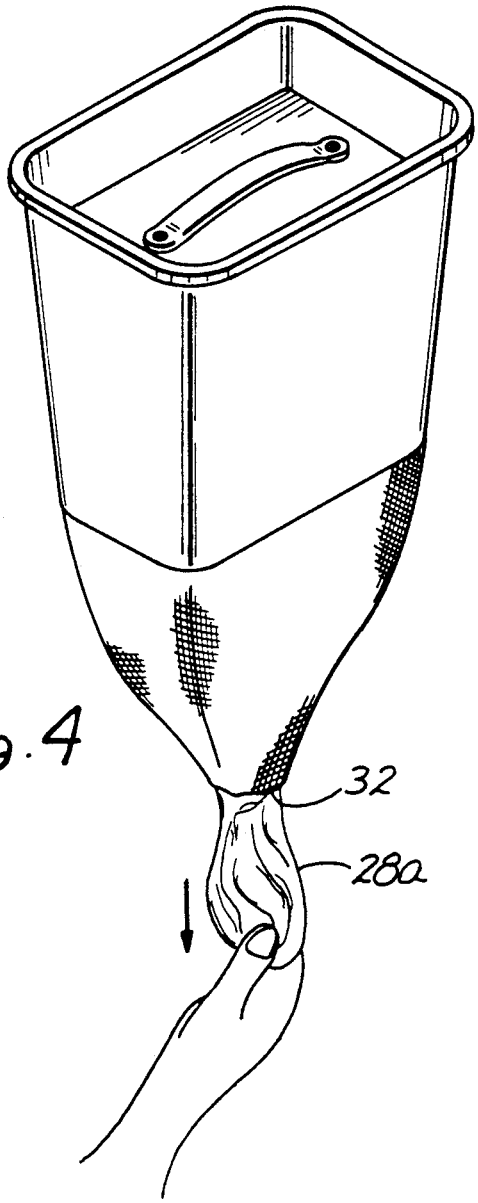
FIG. 4 is a perspective view similar to the views of FIGS. 1A and 2 but showing the manner in which a sack is withdrawn through the hopper-like opening at the bottom of the container.
Figure 5:
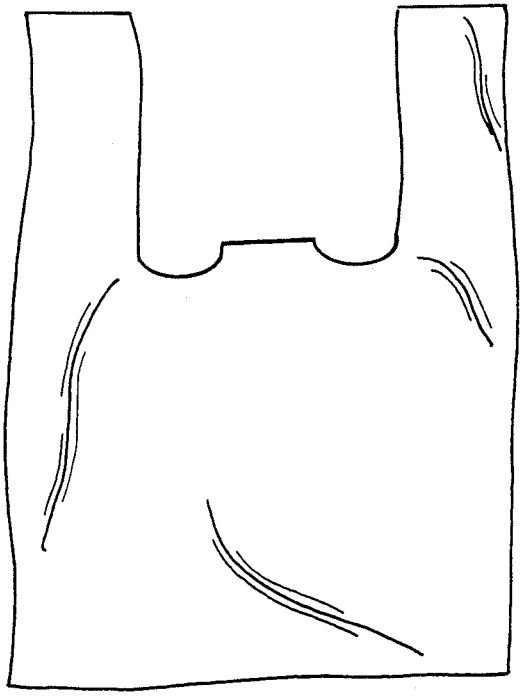
FIG. 5 is a side elevation of a sack after it has been withdrawn from the hopper in the manner shown in FIG. 4 and laid out.

In use, a plurality of sacks 28 are placed in the storage area 14 following which the lid 22 is seated inside the perimeter of the upper edges 10*b* of the walls 10 and pushed down into the space 14 as shown in FIG. 2 thereby compressing the bags 28 downwardly in the space 14 and into the lower space 30 defined by the flexible member 16. The user then inserts a forefinger into the opening 32 at the bottom of the member 16 and withdraws the lowermost bag 28*a* from the lower space 30. It will be found that with this withdrawal of the lowermost bag 28*a*, a subsequent bag will begin to make its appearance through the opening 32, but it will not follow bag 28*a* until it is grasped by the thumb and forefinger of the user and separately withdrawn through the opening 32.

If the size of the vessel formed by the walls 10 is that of a conventional household wastebasket, it will be found that the space 14 and the lower space 30 will accommodate and permit to be individually dispensed a considerable number of the plastic grocery sacks, i.e., 50 to 75. Thus, the householder may store for recycling use such a substantial quantity of the plastic sacks.

The container thus described and illustrated may be mounted by any of several means to a kitchen or washroom wall or inside a cabinet door. Such means could be by screws (not shown) or, preferably, by adhesive elements 34 of the type on which adhesive is provided on both sides. Such elements, of course, are well-known and used in many applications and per se form no part of the present invention.

Figure 6:
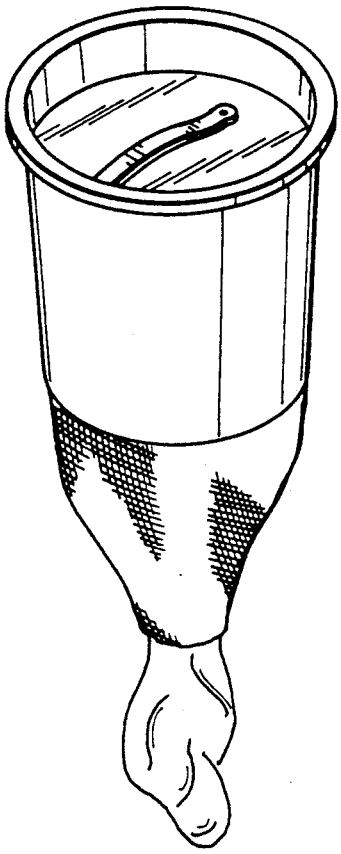
FIG. 6 is a perspective view similar to the view of FIG. 4 showing the container dispenser of the present invention having a circular cross section.
Figure 7:
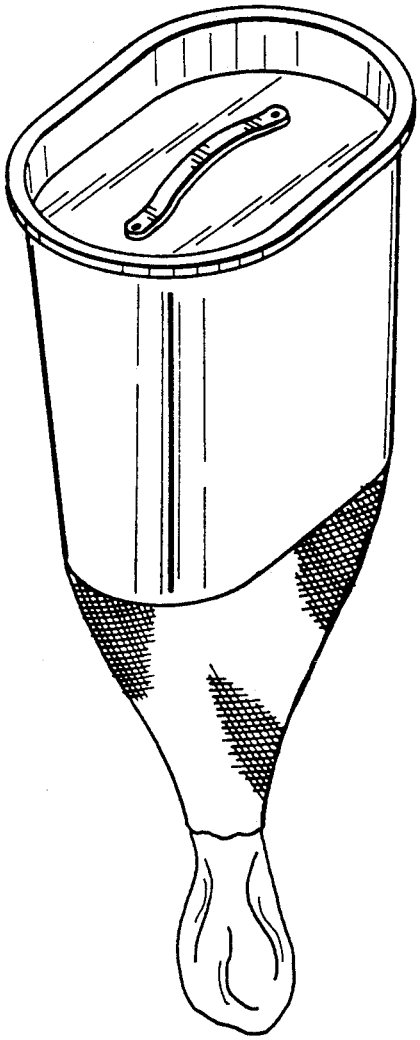
FIG. 7 is a perspective view similar to the view of FIG. 4 showing the container dispenser of the present invention having an elliptical cross section.

While the storage area 14 shown in the drawings is rectangular, it will be appreciated that it could be of other cross-sectional configurations, such as circular and elliptical FIGS. 6 and 7. However, walls defining a rectangular storage area permit the use of parallel adhesive elements 34 for mounting the container on some vertical wall surface, and, as such, are to be preferred.

I claim:

1. A container/dispenser for receiving and storing a plurality of plastic tissue-like grocery sacks in random fashion and presenting the storage sacks for digital removal one at a time, said container/dispenser comprising:

a vessel having a plurality of adjoining walls defining and surrounding a storage space having a vertical axis, said walls having upper edges and lower edges, the upper edges defining an open sack entry area of a predetermined configuration, and the lower edges defining an area of a generally similar configuration, said lower edges having secured thereto further downwardly directed walls, each of said further walls decreasing in area downwardly from said lower edges to approach each other further wall to a point where the lowermost portion of the further walls define an exit area of a predetermined size and configuration to permit a single sack to be withdrawn digitally therefrom when a plurality of sacks have been placed in the storage space in random disposition and compressed downwardly in said storage area toward said exit area, said further walls being flexible with their inwardly facing sides having sufficient roughness to frictionally engage sacks moving in contact with the inside of said further walls; and a lid fitting within the predetermined configuration of the sack entry area into the storage space, said lid including a portion extending downwardly into said storage space and serving to compress downwardly in the storage space a plurality of sacks randomly inserted into said space through said storage space whereby, when sacks are randomly disposed in the storage space and compressed down within the further walls, a lowermost sack may be digitally withdrawn individually through the exit area.

2. The container/dispenser as described in claim 1 wherein the further walls are formed of a course flexible fabric, such as sailcloth.

3. The container/dispenser as described in claim 1 wherein the storage space is rectangular in cross-section.

4. The container/dispenser as described in claim 1 wherein the storage space is circular in cross-section.

5. The container/dispenser as described in claim 1 wherein the storage space is elliptical in cross-section.

6. The container/dispenser as described in claim 1 wherein the perimeter of the upper edges of the walls is at least slightly greater than the perimeter of the lower edges of said walls with the result that the walls are tapered inwardly toward the axis of the storage area.

7. The container/dispenser as described in claim 1 wherein the lid is formed of a series of stepped sections, one below the other, with each lower section being of an area less than the section above it.

8. The container/dispenser as described in claim 1 wherein the lid is provided with a handle protruding upwardly for grasping and moving the lid upwardly or downwardly within the walls defining the storage area.

* * * * *